US011781763B2

(12) United States Patent
Parab et al.

(10) Patent No.: US 11,781,763 B2
(45) Date of Patent: Oct. 10, 2023

(54) AIR FLOW AMPLIFIER FOR HVAC SYSTEM

(71) Applicant: Johnson Controls Technology Company, Auburn Hills, MI (US)

(72) Inventors: Abhishek G. Parab, Oros (IN); Tukaram R. Suryawanshi, Pune (IN); Sumedh J. Suryawanshi, Pune (IN); Satyajit P. Phadtare, Pune (IN); Kirankumar A. Muley, Pune (IN)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 256 days.

(21) Appl. No.: 16/741,527

(22) Filed: Jan. 13, 2020

(65) Prior Publication Data

US 2021/0215362 A1 Jul. 15, 2021

(51) Int. Cl.
*F24F 7/06* (2006.01)
*F24F 7/007* (2006.01)
(Continued)

(52) U.S. Cl.
CPC ..... *F24F 7/065* (2013.01); *F04F 5/16* (2013.01); *F24F 7/007* (2013.01);
(Continued)

(58) Field of Classification Search
CPC ..... F24F 7/065; F24F 7/007; F24F 13/0209; F24F 13/0254; F24F 13/32; F24F 13/30;
(Continued)

(56) References Cited

U.S. PATENT DOCUMENTS 2,488,467 A * 11/1949 De Lisio ..... F04F 5/16 239/561
4,512,264 A * 4/1985 Crawford ..... F23L 17/16 454/39
(Continued)

FOREIGN PATENT DOCUMENTS

CN 101825096 A 9/2010
CN 202900773 U * 4/2013
(Continued)

OTHER PUBLICATIONS

Hu, CN 202900773 Hu machine translated abstract, Apr. 24, 2013, China National Intellectual Property Administration (Year: 2013).*
CN 203685712U Espacenet machine translation, Tan, 2014 (Year: 2014).*

*Primary Examiner* — Allen R. B. Schult
(74) *Attorney, Agent, or Firm* — Fletcher Yoder, P.C.

(57) ABSTRACT

A heating, ventilation, and/or air conditioning (HVAC) unit includes an air flow amplifier coupled to a fan deck of the HVAC unit. The air flow amplifier includes a ring having an annular cavity and an air flow inlet formed in the ring. The air flow inlet is configured to direct an air flow into the annular cavity. The air flow amplifier also includes a first annular air flow outlet formed in the ring and configured to direct a first portion of the air flow out of the annular cavity and along an inner diameter of the ring. The air flow amplifier further includes a second annular air flow outlet formed in the ring and configured to direct a second portion of the air flow out of the annular cavity and along the inner diameter of the ring.

22 Claims, 13 Drawing Sheets

(51) Int. Cl.

| | |
|---|---|
| ***F04F 5/16*** | (2006.01) |
| ***F24F 7/02*** | (2006.01) |
| ***F24F 13/02*** | (2006.01) |
| ***F24F 13/32*** | (2006.01) |
| ***F24F 13/30*** | (2006.01) |

(52) U.S. Cl.
CPC ..... *F24F 13/0209* (2013.01); *F24F 13/0254* (2013.01); *F24F 13/30* (2013.01); *F24F 13/32* (2013.01); *F24F 7/025* (2013.01)

(58) Field of Classification Search
CPC ..... F24F 7/025; F24F 2221/28; F24F 1/01; F24F 7/06; F24F 13/26; F24F 1/60; F15C 1/08; Y10T 137/206; Y10T 137/2147; Y10T 137/212; B63H 2011/002; F04D 29/4246; F04D 25/08; F04D 29/40; F04F 5/16; F04F 5/20; F04F 5/14; F04F 5/466; F04F 5/464; F04F 5/00; Y10S 239/07; F05D 2260/601; F05D 2270/173
USPC ..... 239/DIG. 7; 137/565.22; 454/252, 253, 454/236; 417/197, 179, 54
See application file for complete search history.

(56) References Cited

U.S. PATENT DOCUMENTS

| | | | | | |
|---|---|---|---|---|---|
| 5,938,527 | A * | 8/1999 | Oshima | F24F 1/01 | 454/344 |
| D633,997 | S * | 3/2011 | Hideharu | F04D 25/08 | D23/370 |
| D645,133 | S * | 9/2011 | Hideharu | F04F 5/16 | D23/370 |
| 9,217,445 | B2 * | 12/2015 | Lo | F04D 25/08 | |
| 11,014,034 | B2 * | 5/2021 | Cho | B01D 46/0068 | |
| 2008/0081304 | A1 * | 4/2008 | Poe | F23G 7/08 | 431/202 |
| 2014/0034039 | A1 * | 2/2014 | Qi | F24C 15/20 | 126/299 D |
| 2018/0045203 | A1 * | 2/2018 | Yang | F04F 5/16 | |
| 2018/0283713 | A1 | 10/2018 | Smyth et al. | | |
| 2018/0356124 | A1 * | 12/2018 | Gupte | F24F 3/044 | |
| 2019/0390925 | A1 * | 12/2019 | Sangli | B01F 25/31243 | |

FOREIGN PATENT DOCUMENTS

| | | | |
|---|---|---|---|
| CN | 203685712 U | * | 7/2014 |
| CN | 203962432 U | | 11/2014 |
| CN | 204783838 U | * | 11/2015 |
| JP | S56167897 A | | 12/1981 |

* cited by examiner

AIR FLOW AMPLIFIER FOR HVAC SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system generally includes a vapor compression system having heat exchangers, such as a condenser and an evaporator, which cooperate to transfer thermal energy between the HVAC system and the environment. Generally, a fan or blower is used to direct an air flow across the heat exchangers to facilitate heat exchange between the air flow and a refrigerant circulating through the heat exchangers. For example, the fan typically includes a motor configured to rotate a fan hub about an axis of the fan. A plurality of angled fan blades extend radially from the fan hub, such that rotation of the fan blades induces an air flow from an upstream end portion of the fan to a downstream end portion of the fan. As such, the fan may be used to draw an air flow across, for example, the condenser, to facilitate heat exchange between the air flow and a refrigerant circulating through the condenser. Unfortunately, conventional fans may consume a relatively large amount of power during operation and, thus, may reduce an overall operational efficiency of the HVAC system.

SUMMARY

The present disclosure relates to a heating, ventilation, and/or air conditioning (HVAC) unit including an air flow amplifier coupled to a fan deck of the HVAC unit. The air flow amplifier includes a ring having an annular cavity and an air flow inlet formed in the ring. The air flow inlet is configured to direct an air flow into the annular cavity. The air flow amplifier also includes a first annular air flow outlet formed in the ring and configured to direct a first portion of the air flow out of the annular cavity and along an inner diameter of the ring. The air flow amplifier further includes a second annular air flow outlet formed in the ring and configured to direct a second portion of the air flow out of the annular cavity and along the inner diameter of the ring.

The present disclosure also relates to a heating, ventilation, and/or air conditioning (HVAC) unit including a panel having an opening formed therein and an air flow amplifier positioned adjacent to the opening. The air flow amplifier includes a ring having an annular cavity and an inlet conduit configured to direct a primary air flow into the annular cavity. The air flow amplifier also includes a first air flow outlet formed in the ring and configured to direct a first portion of the primary air flow out of the annular cavity and through the opening in a downstream direction. The air flow amplifier further includes a second air flow outlet formed in the ring and configured to direct a second portion of the primary air flow out of the annular cavity and through the opening in the downstream direction.

The present disclosure also relates to an air flow amplifier for a heating, ventilation, and/or air conditioning (HVAC) unit. The air flow amplifier includes a ring coupled to a structure of the HVAC unit and having an annular cavity configured to receive an air flow. The air flow amplifier also includes a first air flow outlet formed in the ring and configured to direct a first portion of the air flow out of the annular cavity and along an inner diameter of the ring. The air flow amplifier further includes a second air flow outlet formed in the ring and configured to direct a second portion of the air flow out of the annular cavity and along the inner diameter of the ring.

DETAILED DESCRIPTION

Figure 1:
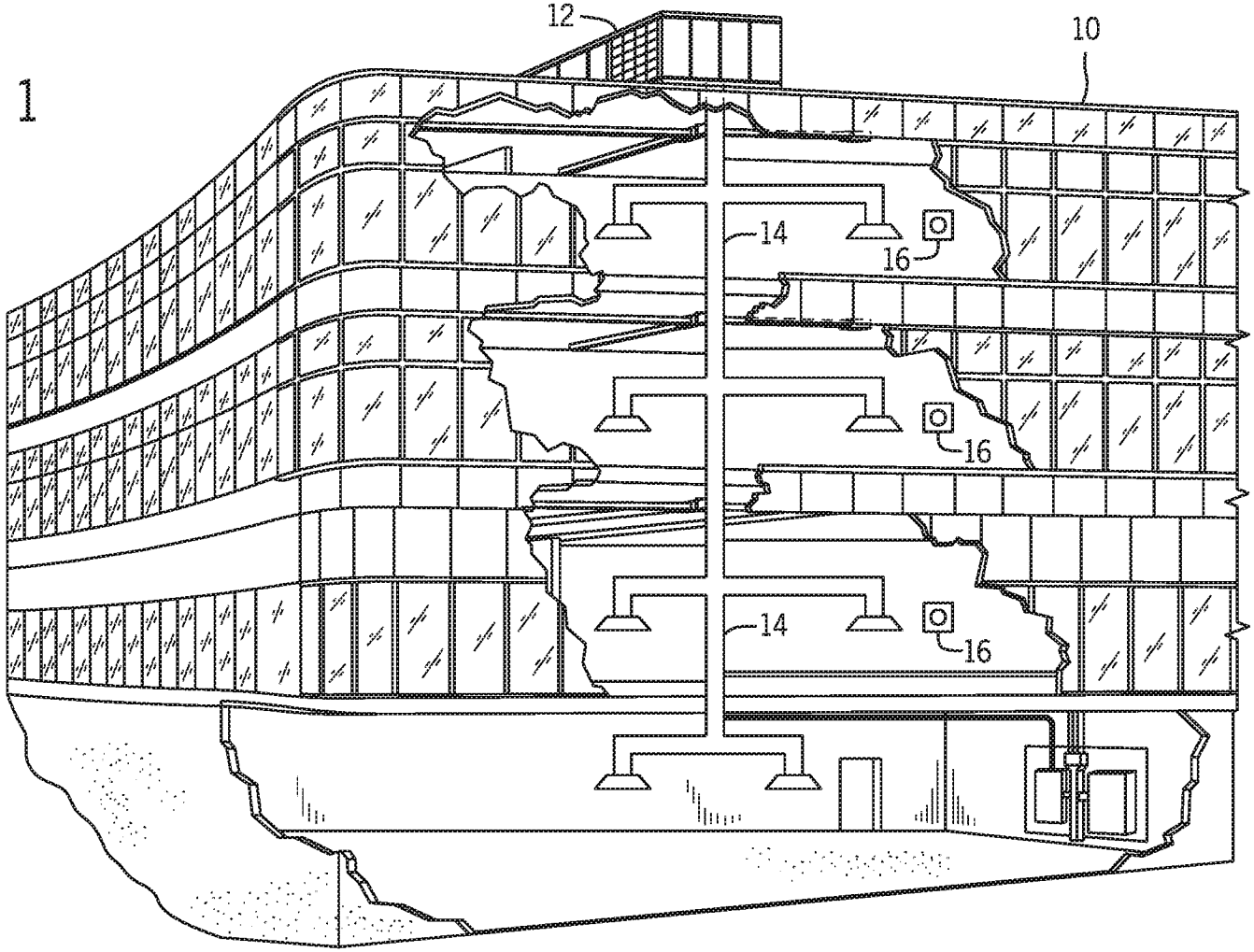
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the conduits and enable the transfer of thermal energy between the condenser and the evaporator.

Generally, the HVAC system includes one or more blowers or fans that are configured to direct an air flow across the heat exchangers and/or along suitable flow paths or ducts of the HVAC system. As briefly discussed above, conventional fans typically include a fan hub having a plurality of angled fan blades extending therefrom and a motor configured to rotate the fan hub about a central axis of the fan hub. Rotation of the fan hub enables the fan blades to engage with air surrounding the fan hub to force the air from an upstream end portion to a downstream end portion of the fan. To this end, the fan may be used to direct an air flow across, for example, the condenser, to facilitate heat exchange between the air flow and the refrigerant circulating through the condenser. Unfortunately, typical fans may consume a relatively large amount of power during operation and, as a result, may reduce an overall operational efficiency of the HVAC system. Moreover, conventional fans implemented in the HVAC system may include various moving components, such as the fan blades and/or a plurality of bearings, which may be exposed to precipitation and/or other environmental elements during operation. As such, these fan components may be susceptible to performance degradation over time.

It is now recognized that utilizing an air flow amplifier to direct air along a flow path of the HVAC system and/or across certain components of the HVAC system may increase an overall operational efficiency of the HVAC system. In particular, it is now recognized that an air flow amplifier may be used to enhance an operational efficiency of a fan or blower implemented in the HVAC system by enabling the fan or blower to more effectively direct air along a flow path of the HVAC system and/or across suitable components of the HVAC system. Moreover, it is now recognized that utilizing an air flow amplifier in outdoor environments may reduce or eliminate exposure of moving fan components to environmental elements of the outdoor environments.

Accordingly, embodiments of the present disclosure are directed to an air flow amplifier that facilitates more efficient direction of air along a flow path of an HVAC system while mitigating or substantially eliminating a likelihood of moving fan components being exposed to ambient environmental elements. For example, the air flow amplifier disclosed herein includes one or more air flow rings that may each include an annular cavity formed therein. The annular cavities are fluidly coupled to a flow generating device, such as a fan, which is configured to supply the annular cavities with an air flow, referred to herein as a primary air flow. The one or more air flow rings include respective outlets that enable the primary air flow to discharge from the annular cavities of the air flow rings and to flow along respective airfoil surfaces of the air flow rings. As discussed in detail below, by directing the primary air flow along the airfoil surfaces, the air flow rings enable the primary air flow to generate a pressure differential across the air flow rings that draws an additional air flow, referred to herein as secondary air flow, through respective flow passages formed by the air flow rings. To this end, the air flow rings may utilize the primary air flow to output a total air flow that includes both the primary air flow and the secondary air flow. As such, the air flow amplifier may increase or amplify an effective air moving capacity of the flow generating device configured to provide the primary air flow. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
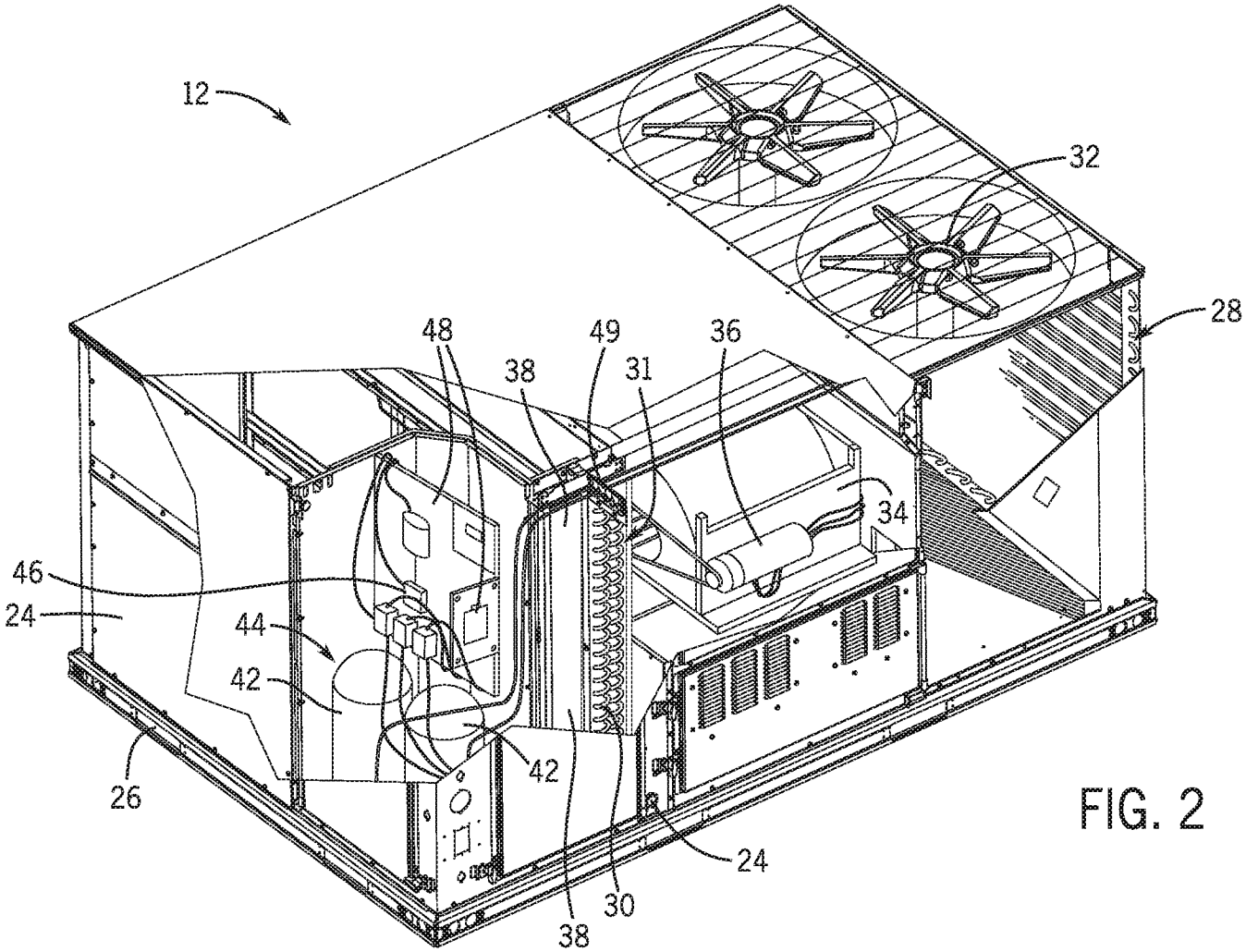
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
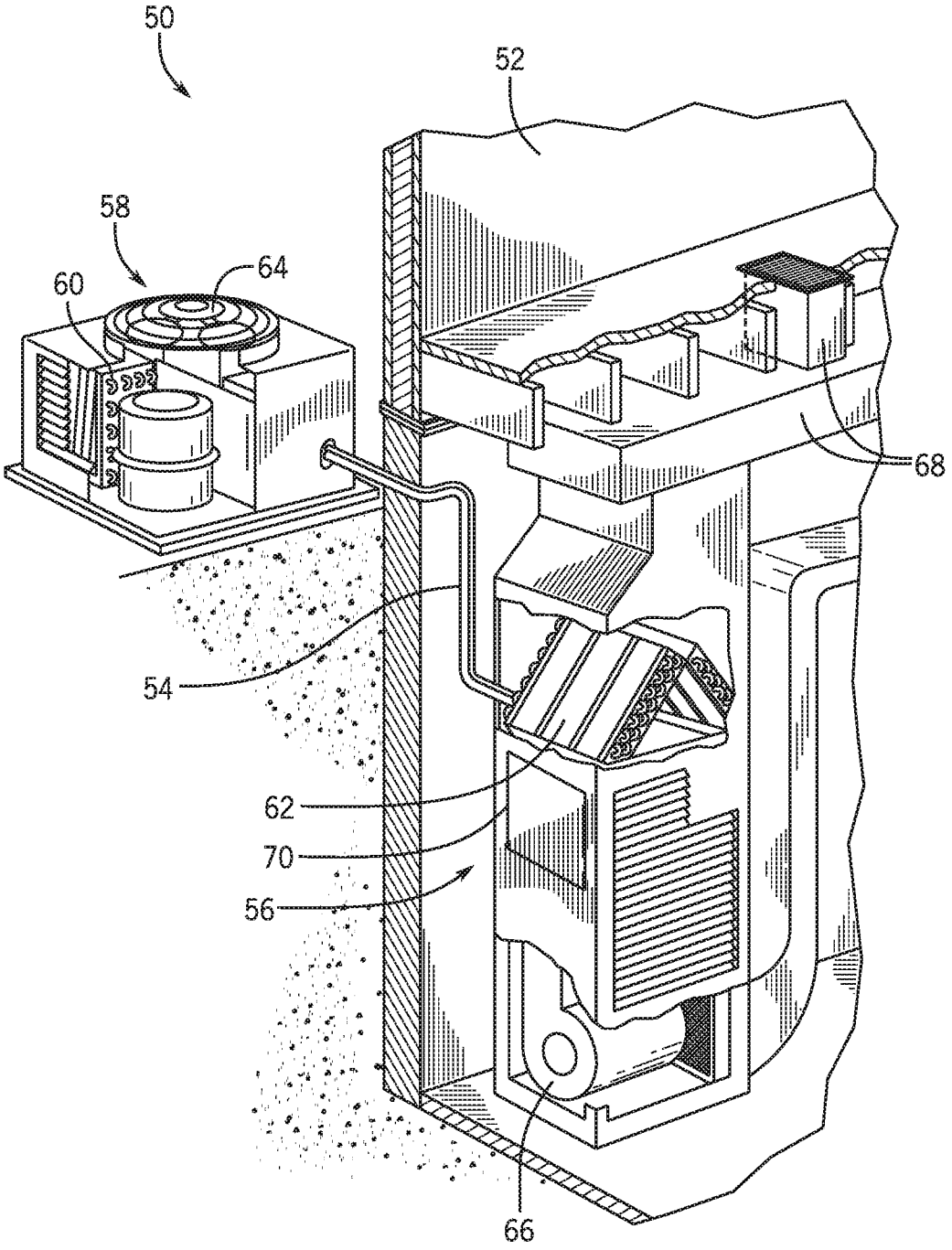
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
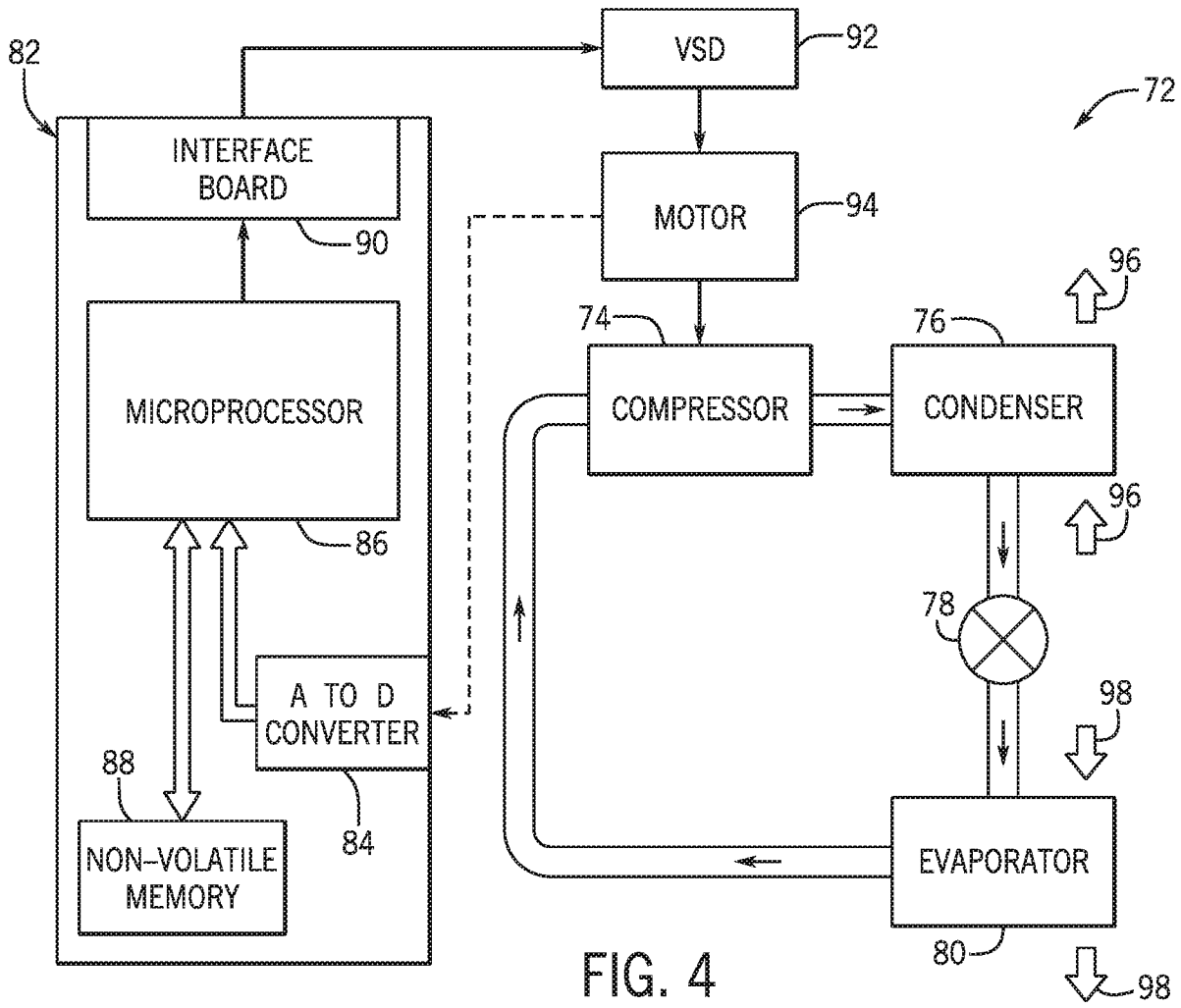
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, HVAC systems typically include one or more fans or blowers that are operable to direct air flows along various flow paths of the HVAC system and/or across certain components of the HVAC system. Unfortunately, conventional fans may consume a relatively large amount of power during operation and, as a result, may lower an overall operational efficiently of the HVAC system. Moreover, typical fans may include moving components, such as fan blades and/or a plurality of bearings, which may be exposed to ambient environment elements and therefore may be susceptible to performance degradation over time. Accordingly, embodiments of the present disclosure are directed to an air flow amplifier that may be used to reduce or substantially eliminate the shortcomings of conventional fans set forth above.

Figure 5:
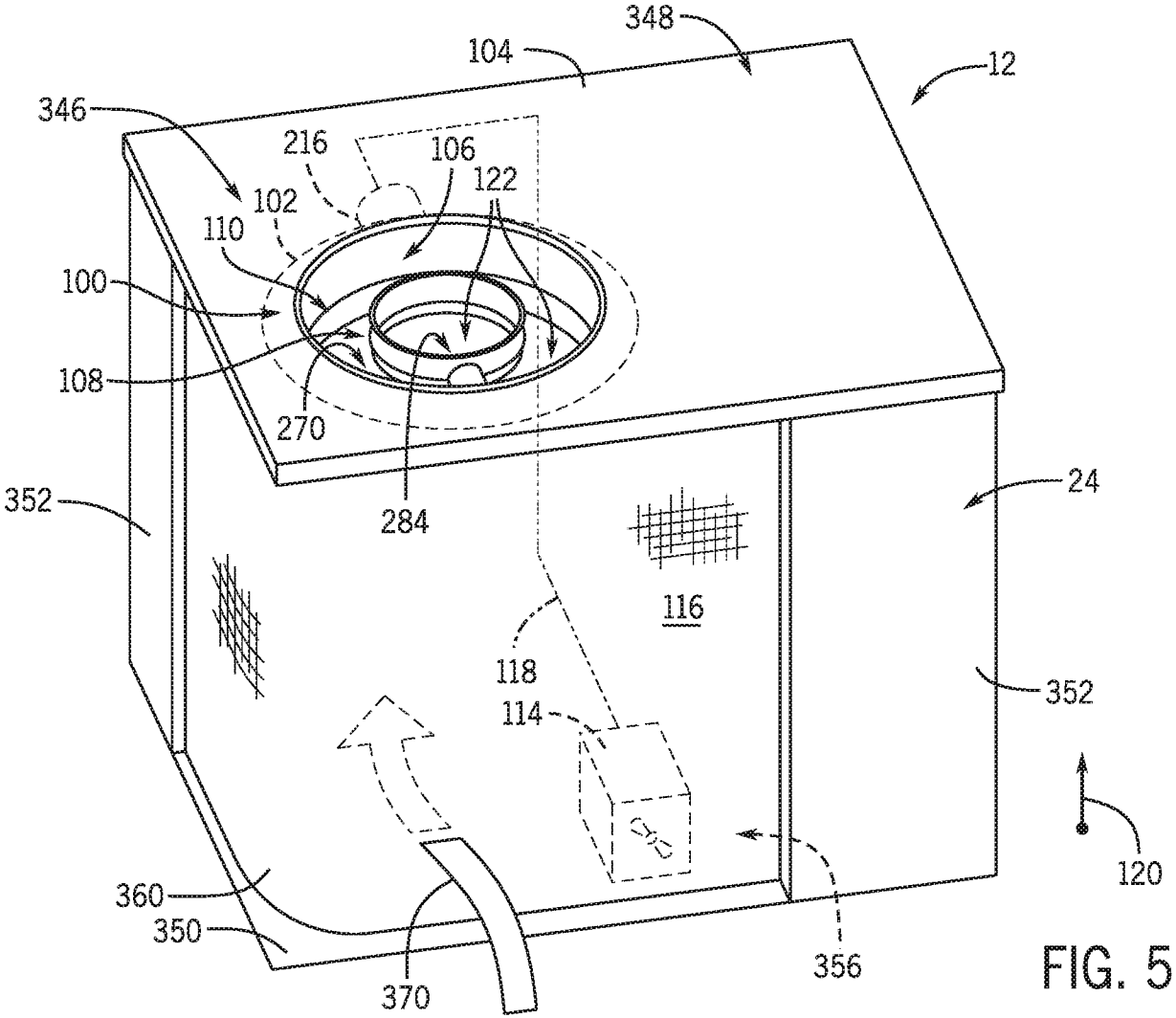
FIG. 5 is a perspective view of an embodiment of an HVAC unit that includes an air flow amplifier, in accordance with an aspect of the present disclosure.

For example, to provide context for the following discussion, FIG. 5 is a perspective view of an embodiment of the HVAC unit 12 that includes an air flow amplifier 100. The air flow amplifier 100 includes a support flange 102 or an annular support structure that facilitates coupling the air flow amplifier 100 to a fan deck 104 or a panel of the cabinet 24. Particularly, the support flange 102 may facilitate aligning an outer ring 106 and an inner ring 108, also referred to herein as an additional ring, of the air flow amplifier 100 with an opening 110 formed within the fan deck 104. As discussed in detail herein, the outer ring 106 and the inner ring 108 include respective annular cavities that are configured to receive an air flow, referred to herein as a primary air flow, supplied by a suitable flow generating device. For example, the outer and inner rings 106, 108 may be fluidly coupled to a fan 114 or a fan assembly configured to supply the outer and inner rings 106, 108 with the primary air flow. The fan 114 may be positioned within an interior 116 of the cabinet 24 and may be fluidly coupled to the outer and inner rings 106, 108 via an air supply conduit 118 or other air flow path. As such, the fan 114 may draw an air flow, such as the primary air flow, from the interior 116 of the cabinet 24 into the air supply conduit 118 and may direct the primary air flow through the air supply conduit 118 and into the annular cavities of the outer and inner rings 106, 108. To this end, the fan 114 may utilize the primary air flow to pressurize the annular cavities of the outer and inner rings 106, 108.

As discussed below, the outer and inner rings 106, 108 are configured to discharge the primary air flow from the annular cavities in a downstream direction 120 through the opening 110. As a result, the primary air flow may generate a pressure differential across the air flow amplifier 100 that induces a secondary air flow through the opening 110 in the downstream direction 120. For clarity, the secondary air flow may be indicative of air that is drawn into central flow passages 122 of the air flow amplifier 100 from the interior 116 of the cabinet 24 and that is expelled from the interior 116 via the opening 110. In some embodiments, a volumetric flow rate of the secondary air flow may be greater than a volumetric flow rate of the primary air flow supplied by the fan 114. Indeed, as discussed below, the air flow amplifier 100 may be configured to utilize primary air supplied at a relatively low volumetric flow rate by the fan 114 to induce discharge of the secondary air from the cabinet 24 at a relatively high volumetric flow rate. As such, the air flow amplifier 100 may increase or amplify an effective volumetric flow rate of air that may be discharged through the opening 110 via operation of the fan 114 and, thus, may enhance an overall operational efficiency of the fan 114. Moreover, the air flow amplifier 100 may reduce or substantially eliminate exposure of moving fan parts to ambient environmental elements, such as precipitation. Particularly, as discussed below, the fan 114 may be positioned at a location within the cabinet 24 that substantially shields the fan 114 from direct exposure to ambient environmental elements. As such, the air flow amplifier 100 may facilitate increase of an operational life of the fan 114 and its components.

Although the air flow amplifier 100 is discussed herein in the context of the HVAC unit 12, it should be understood that embodiments of the air flow amplifier 100 may also be included in embodiments or components of the split, residential HVAC system 50 shown in FIG. 3, a rooftop unit (RTU), or any other suitable HVAC system. Moreover, it should be understood that the air flow amplifier 100 is not limited to implementation on HVAC units and, instead, may be configured to direct air flows through various ducts, terminal units, and/or other air distribution system or components.

Figure 6:
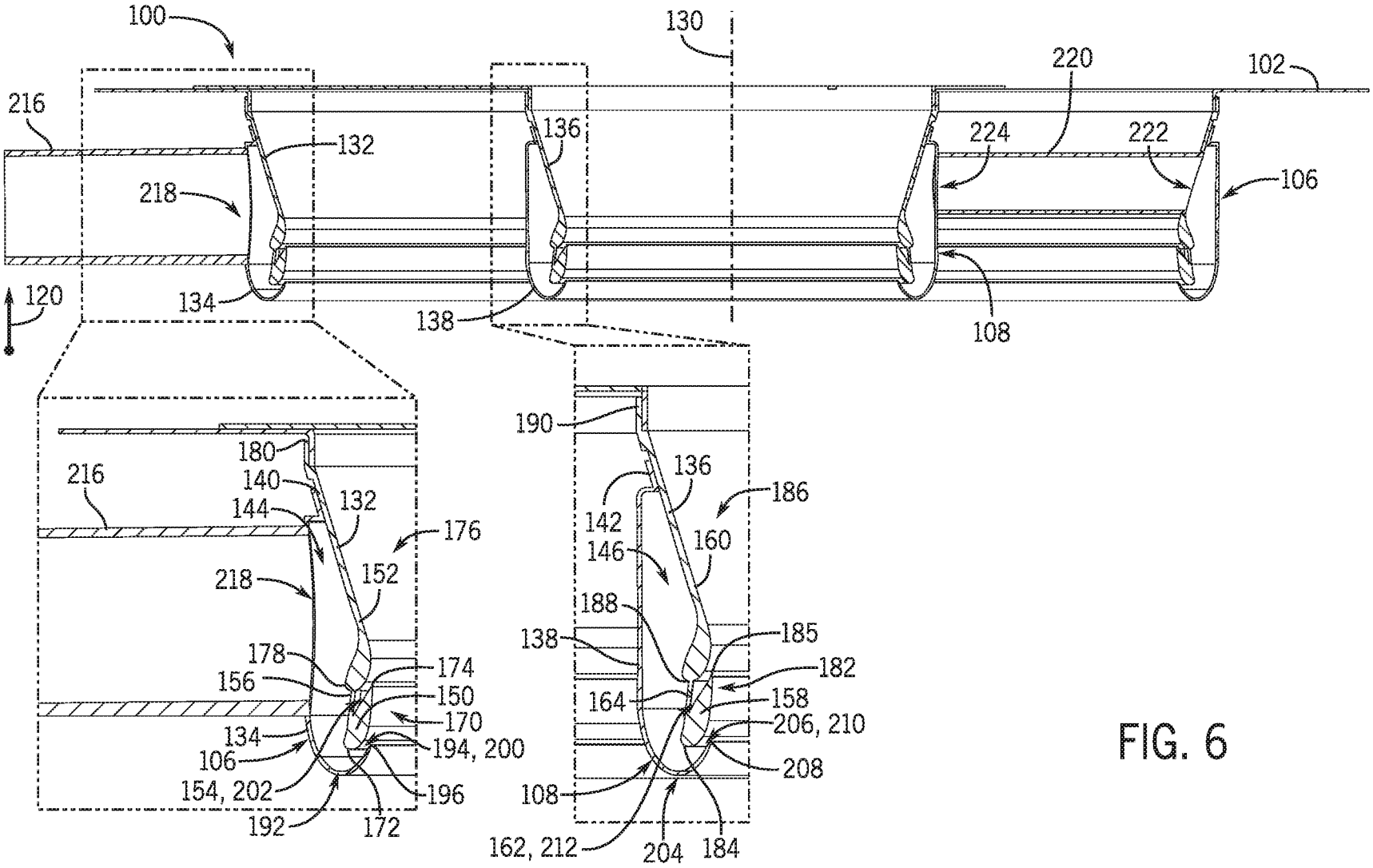
FIG. 6 is a cross-sectional side view of an embodiment of an air flow amplifier, in accordance with an aspect of the present disclosure.

To better illustrate the air flow amplifier 100 and its components, FIG. 6 is a cross-sectional side view of an embodiment of the air flow amplifier 100. As shown in the illustrated embodiment, the outer ring 106 and the inner ring 108 may be positioned concentrically about a central axis 130 of the air flow amplifier 100. The outer ring 106 includes a first inner shroud 132 and a first outer shroud 134 that extend about the central axis 130. The inner ring 108 includes a second inner shroud 136 and a second outer shroud 138 that extend about the central axis 130. The first inner shroud 132 may be coupled to the first outer shroud 134 at a first interface 140, and the second inner shroud 136 may be coupled to the second outer shroud 138 at a second interface 142 via snap joints, fasteners, adhesives, and/or metallurgical processes, such as welding or brazing. As such, the first inner shroud 132 and the first outer shroud 134 may collectively form a first annular cavity 144 of the outer ring 106, while the second inner shroud 136 and the second outer shroud 138 collectively form a second annular cavity 146 of the inner ring 108. For clarity, it should be understood that the first and second annular cavities 144, 146 may each extend partially or completely about the central axis 130. That is, in some embodiments, the first and/or second annular cavities 144, 146 may be separated into one or more cavities that each extend about a portion of the central axis 130.

Figure 7:
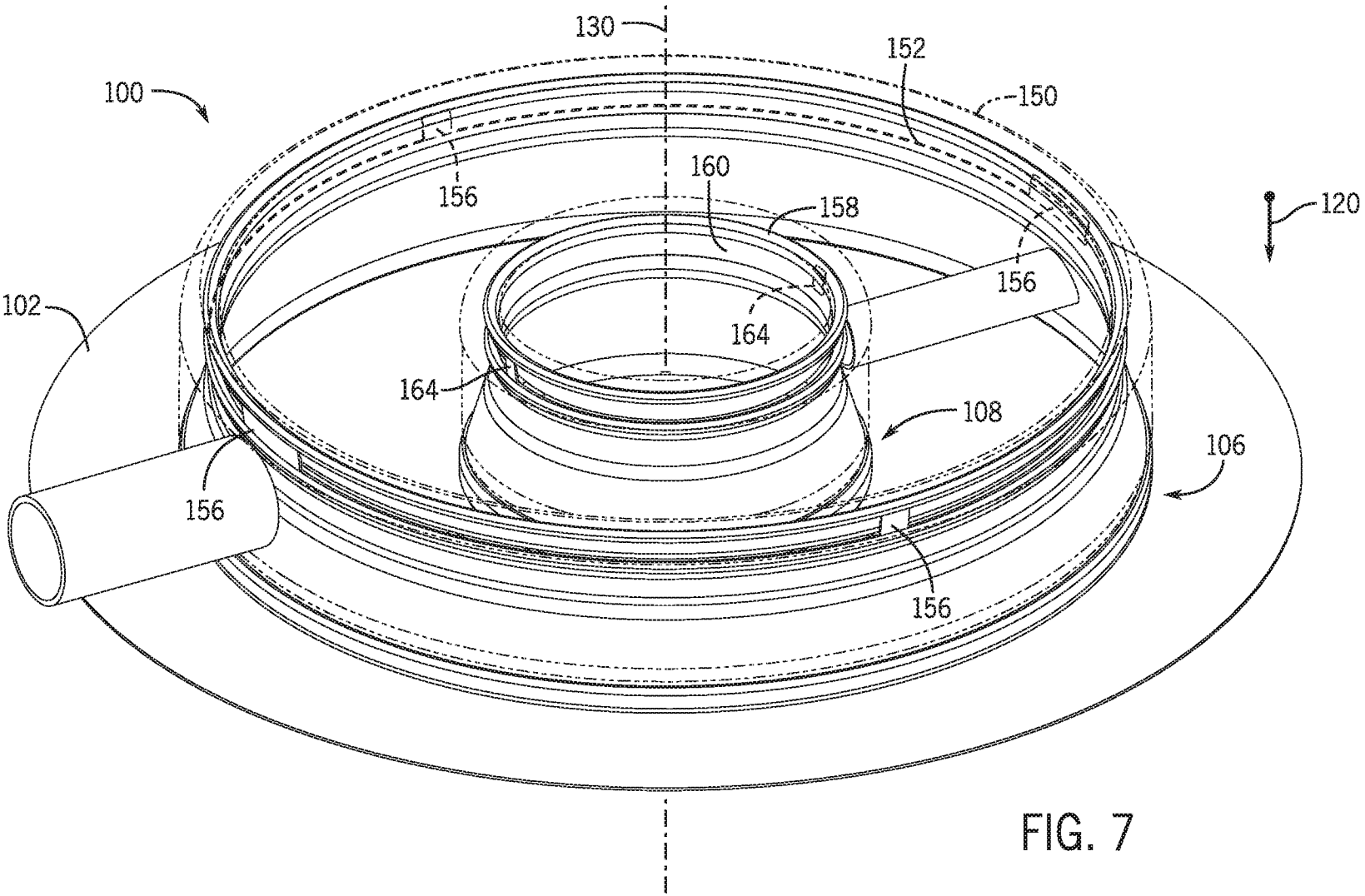
FIG. 7 is a bottom perspective view of an embodiment of an air flow amplifier, in accordance with an aspect of the present disclosure.

The first inner shroud 132 includes a first annular member 150 and a second annular member 152 that are spaced apart by a gap 154 and are coupled to one another via a plurality of first support ribs 156 arrayed circumferentially about the first inner shroud 132. The second inner shroud 136 includes a third annular member 158 and a fourth annular member 160 that, similarly to the first and second annular members 150, 152, are spaced apart by a gap 162 and are coupled to one another via a plurality of second support ribs 164 arrayed circumferentially about the second inner shroud 136. To better illustrate the first and second support ribs 156, 164, FIG. 7 is a perspective view of an embodiment of the air flow amplifier 100. In the illustrated embodiment of FIG.

7, four first support ribs 156 couple the first annular member 150 to the second annular member 152, while two second support ribs 164 couple the third annular member 158 to the fourth annular member 160. However, it should be appreciated that the first support ribs 156 and the second support ribs 164 may include any suitable quantity of support ribs that facilitate coupling the first annular member 150 to the second annular member 152 and that facilitate coupling the third annular member 158 to the fourth annular member 160.

In some embodiments, the first inner shroud 132 may be a single-piece component that includes the first annular member 150, the second annular member 152, and the first support ribs 156. Moreover, the second inner shroud 136 may be a single-piece component that includes the third annular member 158, the fourth annular member 160, and the second support ribs 164. For example, the first inner shroud 132 and the second inner shroud 136 may be formed as single-piece components via an injection molding process and/or an additive manufacturing process. In other embodiments, the respective components of the first inner shroud 132 and the second inner shroud 136 may be coupled to one another using fasteners, adhesives, and/or other suitable techniques.

The following discussion continues with reference to FIG. 6. As shown in the illustrated embodiment, the first annular member 150 includes a first airfoil surface 170 that extends from a leading edge 172 of the first annular member 150 to trailing edge 174 of the first annular member 150. The second annular member 152 includes a second airfoil surface 176 that extends from a leading edge 178 of the second annular member 152 toward a trailing edge 180 of the second annular member 152. The third annular member 158 includes a third airfoil surface 182 that extends from a leading edge 184 of the third annular member 158 to a trailing edge 185 of the third annular member 158. The fourth annular member 160 includes a fourth airfoil surface 186 that extends from a leading edge 188 of the fourth annular member 160 toward a trailing edge 190 of the fourth annular member 160.

In some embodiments, a curved portion 192 of the first outer shroud 134 extends about the leading edge 172 of the first annular member 150 to form a gap 194 between the first annular member 150 and a circumferential edge 196 of the first outer shroud 134. The gap 194 between the first annular member 150 and the circumferential edge 196 will be referred to herein as a first air flow outlet 200 or a first annular air flow outlet of the outer ring 106. The gap 154 between the second annular member 152 and the first annular member 150 will be referred to herein as a second air flow outlet 202 or a second annular air flow outlet of the outer ring 106. As discussed below, the first and second air flow outlets 200, 202 enable pressurized air to discharge from the first annular cavity 144 and to flow along the first and second airfoil surfaces 170, 176 during operation of the air flow amplifier 100. It should be appreciated that, in certain embodiments, the gap 194 forming the first air flow outlet 200 and the gap 154 forming the second air flow outlet 202 may not be continuous gaps extending about the central axis 130. For example, in some embodiments, one or more connectors, such as the first support ribs 156, may separate or divide the gaps 154 and/or 194 into one or more open sections that extend about the central axis 130. Accordingly, as used herein, an annular gap may include a gap that does not extend continuously about the axis 130.

A curved portion 204 of the second outer shroud 138 extends about the leading edge 184 of the third annular member 158 to form a gap 206 between the third annular member 158 and a circumferential edge 208 of the second outer shroud 138. The gap 206 between the third annular member 158 and the circumferential edge 208 will be referred to herein as a third air flow outlet 210 or a third annular air flow outlet of the inner ring 108. The gap 162 between the fourth annular member 160 and the third annular member 158 will be referred to herein as a fourth air flow outlet 212 or a fourth annular air flow outlet of the inner ring 108. As discussed below, the third and fourth air flow outlets 210, 212 enable pressurized air to discharge from the second annular cavity 146 and to flow along the third and fourth airfoil surfaces 182, 186 during operation of the air flow amplifier 100. It should be appreciated that, in certain embodiments, the gap 206 forming the third air flow outlet 210 and the gap 162 forming the fourth air flow outlet 212 may not be continuous gaps. For example, in some embodiments, one or more connectors, such as the second support ribs 156, may separate or divide the gaps 162 and/or 206 into one or more open sections that extend about the central axis 130. Accordingly, as used herein, an annular gap may include a gap that does not extend continuously about the axis 130.

In the illustrated embodiment, the air flow amplifier 100 includes an inlet conduit 216 that is coupled to a radial air flow inlet 218 formed within the first outer shroud 134 of the outer ring 106. As such, the inlet conduit 216 is fluidly coupled to the first annular cavity 144. The air flow amplifier 100 includes an intermediate conduit 220 that extends between a radial air flow outlet 222 formed within the first inner shroud 132 of the outer ring 106 and a radial air flow inlet 224 formed within the second outer shroud 138 of the inner ring 108. Accordingly, the intermediate conduit 220 fluidly couples the first annular cavity 144 to the second annular cavity 146. In some embodiments, the inlet conduit 216 and the intermediate conduit 220 may be positioned on diametrically opposite sides of the outer ring 106. That is, in such embodiments, a centerline of the inlet conduit 216 may extend substantially parallel to a centerline of the intermediate conduit 220. In other embodiments, the inlet conduit 216 and the intermediate conduit 220 may be located at any other suitable positions with respect to one another along a circumference of the outer ring 106. In certain embodiments, the intermediate conduit 220 may be configured to structurally support the inner ring 108 within the outer ring 106.

Figure 8:
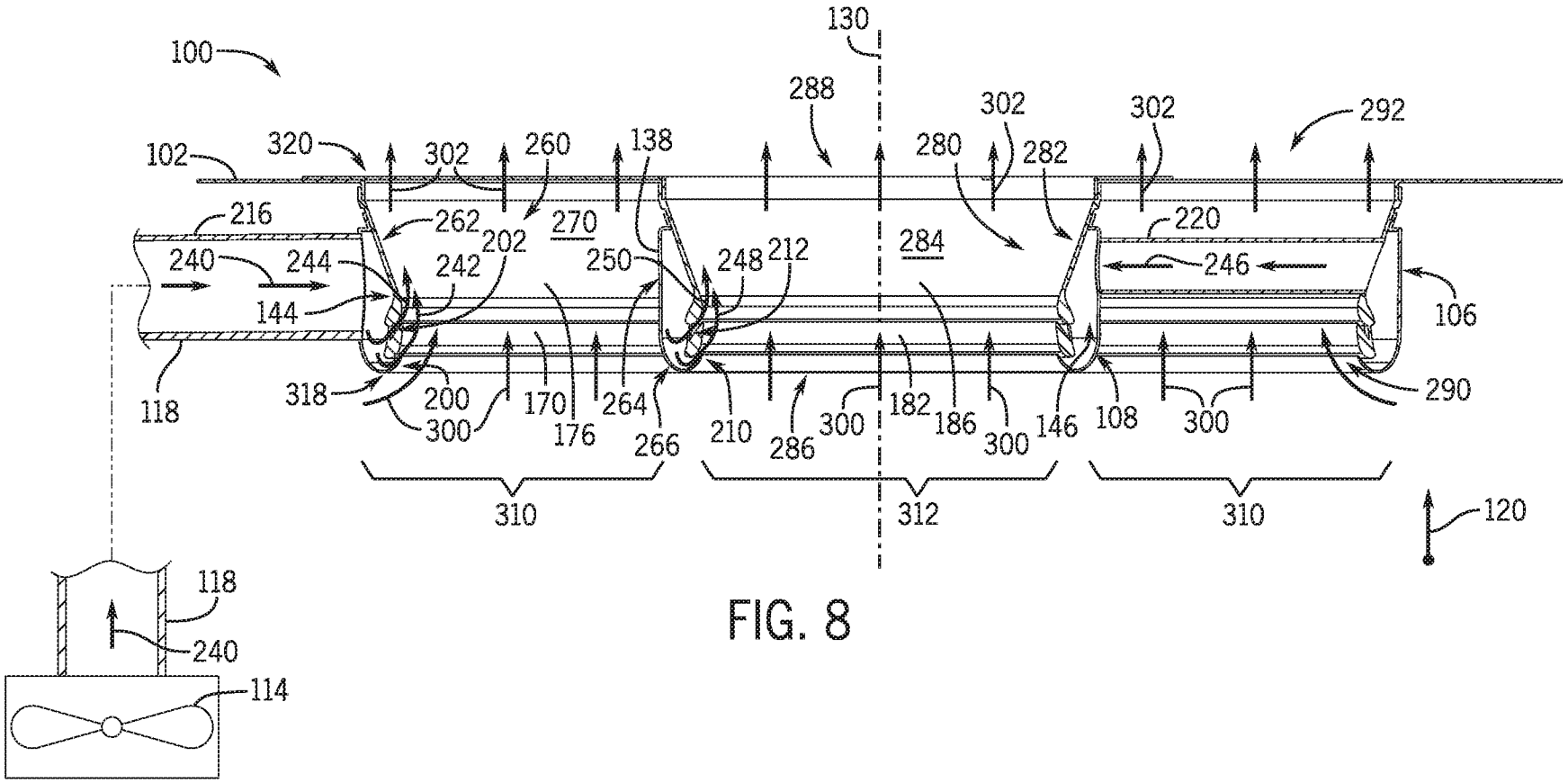
FIG. 8 is a cross-sectional side view of an embodiment of an air flow amplifier, in accordance with an aspect of the present disclosure.

FIG. 8 is a cross-sectional side view of an embodiment of the air flow amplifier 100. As discussed in detail below, the inlet conduit 216 may be fluidly couple to a suitable flow generating device, such as the fan 114, which may be configured to supply an air flow, referred to herein as a primary air flow 240, to the first annular cavity 144. As such, the fan 114 may pressurize the first annular cavity 144, with respect to an ambient pressure surrounding the air flow amplifier 100, via the primary air flow 240. Such pressurization within the first annular cavity 144 may force a first portion of the primary air flow 240, referred to herein as a first air flow 242, through the first air flow outlet 200, and may force a second portion of the primary air flow 240, referred to herein as a second air flow 244, through the second air flow outlet 202. Moreover, the pressurization within the first annular cavity 144 may force a third portion 246 of the primary air flow 240 through the intermediate conduit 220 and into the second annular cavity 146. As such, the third portion 246 of the primary air flow 240 may pressurize the second annular cavity 146, relative to the ambient pressure surrounding the air flow amplifier 100. Such pressurization of the second annular cavity 146 may force a first amount of the third portion 246 of the primary air flow 240, referred to herein as a third air flow 248, through the third air flow outlet 210, and may force a second amount of the third portion 246 of the primary air flow 240, referred to herein as a fourth air flow 250, through the fourth air flow outlet 212.

In some embodiments, a cross-sectional area of the intermediate conduit 220 may be selected to achieve a target air flow rate of the third portion 246 of the primary air flow 240 from the first annular cavity 144 to the second annular cavity 146. For example, in some embodiments, a cross-sectional area of the intermediate conduit 220 may be less than a cross-sectional area of the inlet conduit 216, such that the third portion 246 of the primary air flow 240 delivered to the second annular cavity 146 includes between about 70 percent and about 30 percent of the primary air flow 240, between about 50 percent and about 20 percent of the primary air flow 240, or between about 30 percent and about 10 percent of the primary air flow 240. However, in other embodiments, the intermediate conduit 220 may be sized to deliver any other suitable portion of the primary air flow 240 to the second annular cavity 146. In certain embodiments, the intermediate conduit 220 may be sized to achieve to a target pressurization of the third portion 246 of the primary air flow 240 within the second annular cavity 146. For example, the intermediate conduit 220 may be sized to enable a static pressure of air within the second annular cavity 146 to be greater than, less than, or substantially equal to a static pressure of air within the first annular cavity 144.

The first air flow outlet 200 may direct the first air flow 242 along the first airfoil surface 170, and the second air flow outlet 202 may direct the second air flow 244 along the second airfoil surface 176. It should be understood that the first air flow 242 may mix with the second air flow 244 and/or may flow along the second airfoil surface 176 after flowing across the first airfoil surface 170. The first airfoil surface 170 and the second airfoil surface 176 may be Coanda surfaces that cause the first and/or second air flows 242, 244 to adhere to a contour of the first and second airfoil surfaces 170, 176 when flowing along the first and second airfoil surfaces 170, 176.

The third air flow outlet 210 may direct the third air flow 248 along the third airfoil surface 182, and the fourth air flow outlet 212 may direct the fourth air flow 250 along the fourth airfoil surface 186. Similar to the first air flow 242 discussed above, the third air flow 248 may mix with the fourth air flow 250 and/or flow along the fourth airfoil surface 186 after flowing across the third airfoil surface 182. The third airfoil surface 182 and the fourth airfoil surface 186 may be Coanda surfaces that cause the third and/or fourth air flows 248, 250 to adhere to a contour of the third and fourth airfoil surfaces 182, 186 when flowing along the third and fourth airfoil surfaces 182, 186.

The first airfoil surface 170 and the second airfoil surface 176 may be collectively referred to herein as an inner diameter 260 of the outer ring 106. For example, the first airfoil surface 170 and the second airfoil surface 176 may define the inner diameter 260 of the outer ring 106. As shown in the illustrated embodiment, at least a portion of the inner diameter 260, referred to herein as a diverging portion 262, diverges radially, in the downstream direction 120, from the central axis 130. In some embodiments, at least a portion, referred to herein as a linear portion 264, of an outer surface 266 of the second outer shroud 138 may extend substantially parallel to the central axis 130. In this way, the outer ring 106 and the inner ring 108 may form a first flow passage 270 or an annular flow passage that extends between the inner diameter 260 of the outer ring 106 and the outer surface 266 of the inner ring 108, where a radial dimension of at least a portion of the first flow passage 270 increases along the downstream direction 120.

The third airfoil surface 182 and the fourth airfoil surface 186 may be collectively referred to as an inner diameter 280 of the inner ring 108. For example, the third airfoil surface 182 and the fourth airfoil surface 186 may define the inner diameter 280 of the inner ring 108. In the illustrated embodiment, at least a portion of the inner diameter 280, referred to herein as a diverging portion 282, diverges radially, along the downstream direction 120, from the central axis 130. As such, the inner ring 108 may form a second flow passage 284 that extends from a upstream end portion 286 to a downstream end portion 288 of the inner ring 108, where a radial dimension of at least a portion of the second flow passage 284 increases along the downstream direction 120.

The respective profiles of the first and second airfoil surfaces 170, 176 may cause the first air flow 242 and the second air flow 244 to accelerate when flowing along the inner diameter 260 of the outer ring 106 from an upstream end portion 290 toward a downstream end portion 292 of the air flow amplifier 100. The respective profiles of the third and fourth airfoil surfaces 182, 186 may cause the third air flow 248 and the fourth air flow 250 to accelerate when flowing along the inner diameter 280 of the inner ring 108 from the upstream end portion 290 toward the downstream end portion 292 of the air flow amplifier 100. As a result, the first, second, third, and fourth air flows 242, 244, 248, 250 may generate a region of relatively low pressure within the first and second flow passages 270, 284 that is less than an ambient pressure surrounding the air flow amplifier 100. This pressure differential between the air within the first and second flow passages 270, 284 and the ambient environment may induce a secondary air flow 300 that is drawn into the first and second flow passages 270, 284 at the upstream end portion 290 and in the downstream direction 120. That is, the relatively low pressure within the first and second flow passages 270, 284 may force the secondary air flow 300 from a region of relatively high pressure, such as near the upstream end portion 290 of the air flow amplifier 100, into and through the first and second flow passages 270, 284 in the downstream direction 120. As a result, the air flow amplifier 100 may discharge a total air flow 302 at the downstream end portion 292 that includes the primary air flow 240, which is discharged via the first, second, third, and fourth air flow outlets 200, 202, 210, 212 as the first, second, third, and fourth air flows 242, 244, 248, 250, respectively, as well as the secondary air flow 300.

In some embodiments, the secondary air flow 300 may have a volumetric flow rate that is approximately equal to or is greater than a volumetric flow rate of the primary air flow 240. As an example, the volumetric flow rate of the secondary air flow 300 may be double, triple, quadruple, or more than quadruple the volumetric flow rate of the primary air flow 240. Indeed, during operation, the air flow amplifier 100 draw a volumetric flow rate of air into the first and second flow passages 270, 284 that is higher than a volumetric flow rate of the primary air flow 240 supplied by the fan 114 to the first and second annular cavities 144, 146. To this end, the air flow amplifier 100 may enhance, such as multiply, an effective air moving capacity of the fan 114 and, thus, increase an operational efficiency of the fan 114. That is, the air flow amplifier 100 may utilize the primary air flow 240, which may be supplied by the fan 114 at a first volumetric flow rate, to induce the secondary air flow 300 at an amplified or increased second volumetric flow rate that is greater than the first volumetric flow rate of the primary air flow 240. In this way, the air flow amplifier 100 functions to increase a total air flow rate through the interior 116 of the cabinet 24 and/or discharged through the opening 110 of the cabinet 24 without increasing a size or capacity of the fan 114, thereby reducing costs associated with implementing and operating the fan 112.

In some embodiments, the inner ring 108 may be positioned concentrically within the outer ring 106. The inner ring 108 may facilitate more effective induction of the secondary air flow 300 through the air flow amplifier 100, thereby increasing an operational efficiency of the air flow amplifier 100. For example, the first and second air flows 242, 244 discharging from the outer ring 106 may predominately induce an annular portion 310 of the secondary air flow 300 that flows through the air flow amplifier 100 between the inner diameter 260 of the outer ring 106 and the outer surface 266 of the second outer shroud 138, which may also be referred to as an outer diameter of the inner ring 106. Therefore, in some embodiments, the outer ring 106 may not generate or substantially generate an induced air flow near a center of the outer ring 106, such as proximate the central axis 130. Particularly, when a diametric dimension of the outer ring 106 is relatively large, the outer ring 106 may not adequately induce an air flow near the central axis 130. As such, an average flow rate or average flow velocity of the secondary air flow 300 drawn into the air flow amplifier 100 near the central axis 130 may be less than an average flow rate or average flow velocity of the secondary air flow 300 drawn into the air flow amplifier 100 near the inner diameter 260. In other words, operation of the outer ring 106 alone may induce the secondary air flow 300 through the air flow amplifier 100 with a substantially non-uniform and/or unbalanced air flow velocity profile. Accordingly, embodiments of the air flow amplifier 100 discussed herein may be equipped with the inner ring 108, which may facilitate induction of the secondary air flow 300 air flow near the central axis 130. That is, the inner ring 108 may facilitate induction of a central portion 312 of the secondary air flow 300 that is drawn into the air flow amplifier 100 near or proximate the central axis 130. In this manner, the inner ring 108 may facilitate a more even velocity profile of the secondary air flow 300 into the air flow amplifier 100 across a diametric dimension of the outer ring 106.

In some embodiments, it may be desirable to discharge the primary air flow 240 from the outer and inner rings 106, 108 at a particular flow rate while mitigating a pressure increase within the inlet conduit 216, the first annular cavity 144, and/or the second annular cavity 146. Indeed, by reducing a pressure increase within the inlet conduit 216, the first annular cavity 144, and/or the second annular cavity 146, an operational load on the fan 114 may be reduced. For example, an embodiment of the air flow amplifier 100 having two air flow outlets in the outer ring 106, such as the first and second air flow outlets 200, 202, may enable, with relatively low pressurization within the first annular cavity 144, discharge of primary air 240 through the first and second air flow outlets 200, 202 at a first flow rate that may be substantially similar to a second flow rate of primary air 240 that may be discharged from an embodiment of the air flow amplifier 100 in which the outer ring 106 includes a single air flow outlet, such as the first air flow outlet 200, and is pressurized to a relatively high pressurization. To this end, embodiments of the outer ring 106 including multiple air flow outlets may facilitate effective induction of the secondary air flow 300 while an air pressure within the first annular cavity 144 is kept relatively low. As such, an overall power consumption of the fan 114 may be reduced, thereby increasing the operational efficiency of the air flow amplifier 100. It should be understood that, in accordance with the aforementioned techniques, including multiple air flow outlets in the inner ring 108, such as the third and fourth air flow outlets 210, 212, may further increase an operational efficiency of the air flow amplifier 100. Although the outer and inner rings 106, 108 each include two air flow outlets in the illustrated embodiment, in other embodiments, the outer and inner rings 106, 108 may each include any suitable quantity of air flow outlets, such as 1, 2, 3, 4, or more than four air flow outlets.

In some embodiments, an upstream end portion 318 of the outer ring 106 may be substantially coplanar to the upstream end portion 286 of the inner ring 108. Moreover, a downstream end portion 320 of the outer ring 106, which may be coupled to the support flange 102, may be substantially coplanar to the downstream end portion 288 of the inner ring 108. In other embodiments, the respective upstream end portions 318, 286 and the respective downstream end portions 320, 288 of the outer and inner rings 106, 108 may be offset from one another along the central axis 130.

Figure 9:
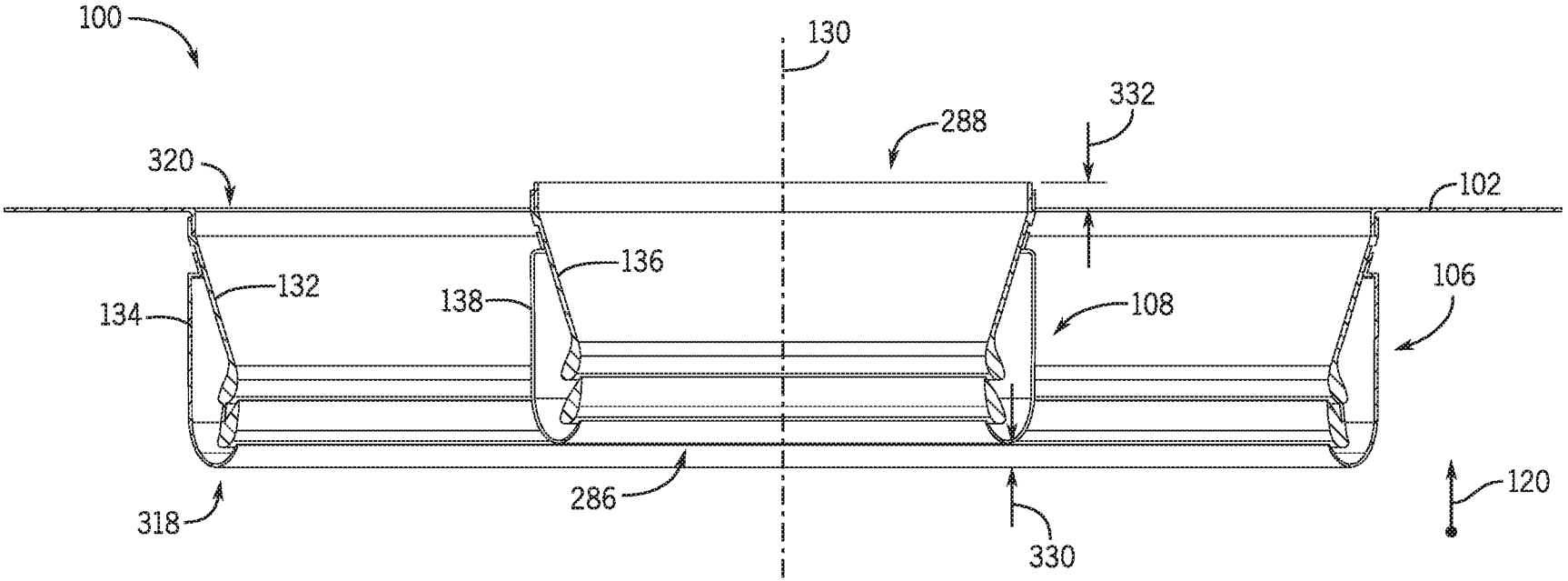
FIG. 9 is a cross-sectional side view of an embodiment of an air flow amplifier, in accordance with an aspect of the present disclosure.

For example, FIG. 9 is a cross-sectional side view of another embodiment of the air flow amplifier 100, in which the upstream end portion 318 of the outer ring 106 is positioned upstream of the upstream end portion 286 of the inner ring 108, relative to the flow direction of the secondary air flow 300 through the air flow amplifier 100, by a first dimension 330, and the downstream end portion 288 of the inner ring 108 is positioned downstream of the downstream end portion 320 of the outer ring 106, relative to the flow direction of the secondary air flow 300 through the air flow amplifier 100, by a second dimension 332. In some embodiments, offsetting the inner ring 108 from the outer ring 106 by the first dimension 330 and/or the second dimension 332 may facilitate more effective generation of the secondary air flow 300 during operation of the air flow amplifier 100. It should be understood that, in other embodiments, the upstream end portion 286 of the inner ring 108 may be otherwise offset from the upstream end portion 318 of the outer ring 106 along the central axis 130 and/or the downstream end portion 320 of the outer ring 106 may be otherwise offset from the downstream end portion 288 of the inner ring 108 along the central axis 130. For example, in some embodiments, the outer ring 106 may axially and circumferentially extend about the inner ring 108, such that the inner ring 108 is fully axially and circumferentially encompassed by the outer ring 106.

Figure 10:
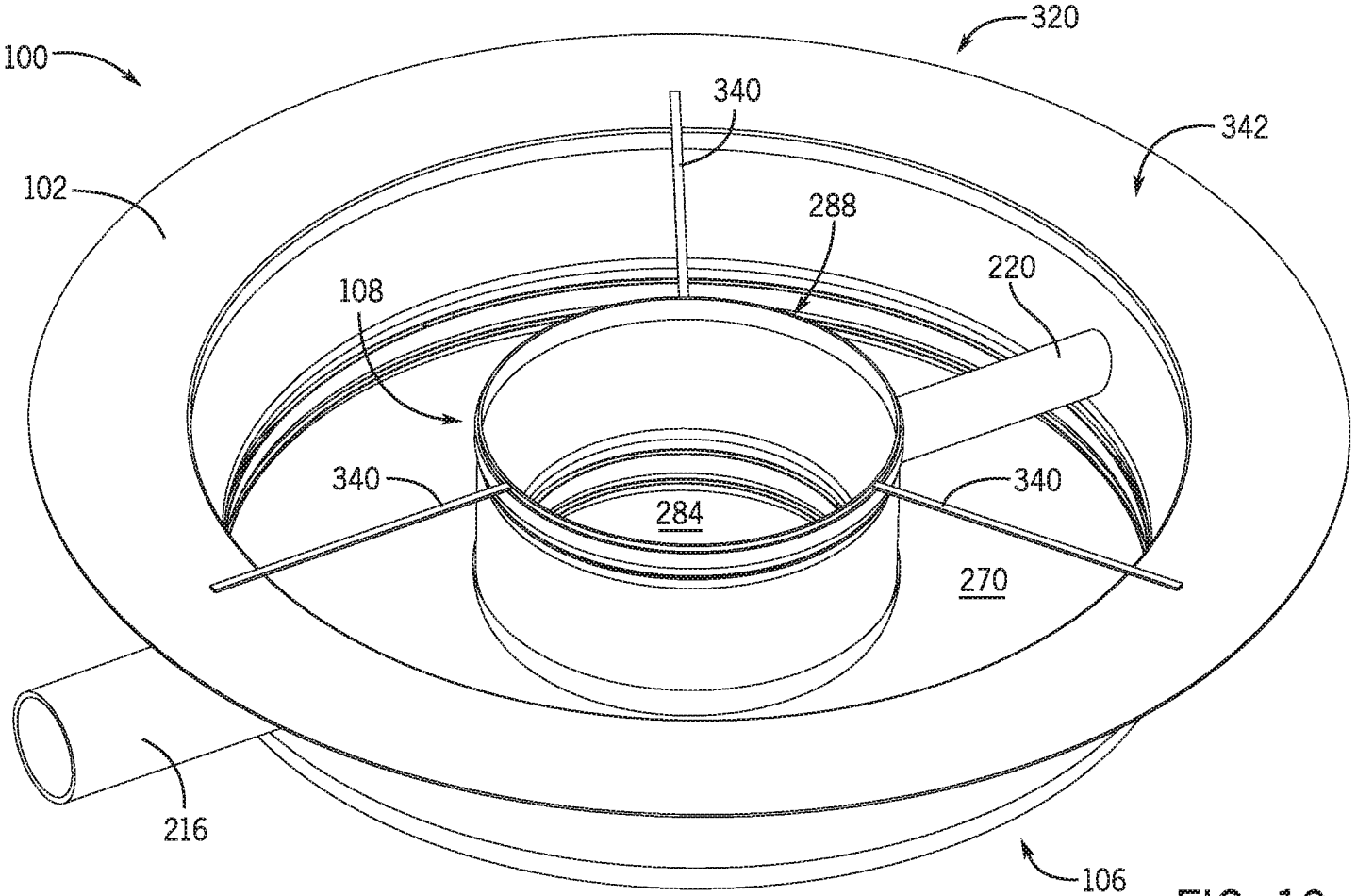
FIG. 10 is a top perspective view of an embodiment of an air flow amplifier, in accordance with an aspect of the present disclosure.

FIG. 10 is a perspective view of an embodiment of the air flow amplifier 100. As discussed above, in some embodiments, the support flange 102 is coupled to the outer ring 106 via adhesives, fasteners, or a metallurgical process, such as welding or brazing. Particularly, the support flange 102 may be coupled to a circumference of the outer ring 106 near, adjacent, or at the downstream end portion 320 of the outer ring 106. As discussed below, the support flange 102 may be configured to support some of or substantially all of a weight of the air flow amplifier 100 when the air flow amplifier 100 is in an installed configuration on the HVAC unit 12. In some embodiments, one or more support braces 340 may extend between the inner ring 108 and the support flange 102, such as in a radial direction relative to the central axis 130, and may be configured to support the inner ring 108 within the outer ring 106. For example, the support braces 340 may position the inner ring 108 such that the downstream end portion 288 of the inner ring 108 is positioned upstream, with respect to a direction of air flow through the first and second flow passages 270, 284, of a surface 342 of the support flange 102. As discussed below, in this manner, the inner ring 108 may not protrude past the fan deck 104 of the HVAC unit 12 when the air flow amplifier 100 is coupled to the HVAC unit 12. In other words, the inner ring 108 is effectively recessed within the fan deck 104 and/or the cabinet 24. Accordingly, another HVAC unit may be stacked atop the HVAC unit 12 during transportation and/or storage of the HVAC units without interfering with the air flow amplifier 100 installed in the HVAC unit 12.

The following discussion continues with reference to FIG. 5. In the illustrated embodiment, the air flow amplifier 100 is in an installed configuration 346 in the HVAC unit 12. In the installed configuration 346, the support flange 102 is coupled to the fan deck 104 via fasteners, adhesives, and/or other suitable techniques. As mentioned above, in the installed configuration 346 of the air flow amplifier 100, the outer ring 106 and/or the inner ring 108 may be positioned below, with respect to a direction of gravity, a surface 348 of the fan deck 104, such that the air flow amplifier 100 does not protrude past the fan deck 104 and/or protrude outside of the cabinet 24. As such, another HVAC unit may be stacked on the fan deck 104 of the HVAC unit 12 during transportation and/or storage of the HVAC units without interfering with the air flow amplifier 100. In some embodiments, a shroud may be disposed over the opening 110 of the fan deck 104 to block debris, such as leaves, from entering the interior 116 of the cabinet 24 through the first and second flow passages 270, 284 of the air flow amplifier 100. In other embodiments, the shroud may be omitted from the HVAC unit 12.

As discussed above, the fan 114 may be fluidly coupled to the inlet conduit 216 of the air flow amplifier 100 via the air supply conduit 118 and may be configured to supply the air flow amplifier 100 with the primary air flow 240. The fan 114 may be disposed within the interior 116 of the cabinet 24 and may be coupled to a base panel 350, a side panel, a floor, frame rails, or other support structure of the HVAC unit 12. In some embodiments, coupling the fan 114 to the base panel 350, instead of to the fan deck 104, may reduce an intensity of vibrations that may propagate from the fan 114 to other components of the cabinet 24 during operation of the fan 114. For example, by coupling the fan 114 to a sturdy or durable support structure, such as the base panel 350 and/or frame rails of the HVAC unit 12, vibrations generated during operation of the fan 114 may be transferred into these support structures and substantially attenuated. As such, an intensity of vibrations transferred to other components of the cabinet 24, such as the fan deck 104 and/or side panels 352 of the cabinet 24, may be substantially reduced, as compared to an intensity of vibrations that may be transferred to these components in typical HVAC units that may include a fan or fan assembly coupled to or mounted to the fan deck 104. Moreover, by coupling or mounting the fan 114 to the base panel 350 or other durable support structure of the HVAC unit 12, such that the fan deck 104 does not support a weight of the fan 114, a thickness of material, such as sheet metal, used to form the fan deck 104 may be reduced.

The fan 114 may be positioned at a location within the cabinet 24 at which the fan 114 is substantially shielded from direct exposure to environmental elements, such as precipitation. For example, the fan 114 may be positioned at or in a corner portion 356 within the cabinet 24 that is covered by the fan deck 104 and/or other elements of the cabinet 24. In this manner, components of the fan 114 that move during operation, such as fan blades, bearings, and/or a motor configured to drive rotation of the fan blades, may be shielded from exposure to these environmental elements, which may extend an operational life and/or may reduce a frequency or cost of maintenance of the components.

In certain embodiments, the HVAC unit 12 includes a heat exchanger 360, such as the heat exchanger 28, which is positioned within and/or which forms a portion of the cabinet 24. For example, the heat exchanger 360, the fan deck 104, the base panel 350, and the side panels 352 may enclose the interior 116 of the cabinet 24. The fan 114 may be configured to draw in air, such as the primary air 240, into the air supply conduit 118 from the interior 116 of the cabinet 24, to direct the primary air 240 through the air supply conduit 118, and to force the primary air 240 into the air flow amplifier 100. As such, the air flow amplifier 100 may discharge the primary air 240 through the opening 110, such as via the first, second, third, and fourth air flow outlets 200, 202, 210, 212 discussed above, and into an ambient environment surrounding the HVAC unit 12. In accordance with the techniques discussed above, the air flow amplifier 100 may draw the induced, secondary air flow 300 from the interior 116 into the first and second flow passages 270, 284 and may discharge the secondary air flow 300 through the opening 110 into the ambient environment. As such, by discharging the primary air flow 240 and the secondary air flow 300 from the interior 116 of cabinet 24, the air flow amplifier 100 may reduce a pressure within the cabinet 24, such that an ambient atmospheric pressure surrounding the HVAC unit 12 is sufficient to force a flow of cooling air 370 across the heat exchanger 360 and into the interior 116. To this end, it should be understood that the cooling air 370 may be an air flow that enters the cabinet 24 to replace the primary air flow 240 and the secondary air flow 300 discharged from the interior 116. In other words, the air flow amplifier 100 may be used to draw both the primary air flow 240 and the secondary air flow 300 across a heat exchange area of the heat exchanger 360. Accordingly, the air flow amplifier 100 may facilitate heat exchange between a refrigerant circulating through the heat exchanger 360 and the primary and secondary air flows 240, 300.

In some embodiments, the air supply conduit 118 may be fluidly coupled to another air supply source in addition to, or in lieu of, the fan 114. For example, in certain embodiments, the air supply conduit 118 may be coupled to a supply air blower, such as the blower 34, which is configured to direct a supply air flow into rooms or spaces within the building 10 via the ductwork 14. A portion of the supply air flow may be diverted from the ductwork 14 and directed into the air flow amplifier 100 via the air supply conduit 118. To this end, the supply air blower may be used to drive operation of the air flow amplifier 100. Accordingly, in such embodiments, the fan 114 may be omitted from the HVAC unit 12, such that the HVAC unit 12 does not include a dedicated flow generating device for generating an air flow across the heat exchanger 360.

It certain embodiments, some or all of the components of the air flow amplifier 100 may be made of one or more polymeric materials, such as a plastic. For example, components of the outer and inner rings 106, 108, the inlet conduit 216, the intermediate conduit 220, and/or the support flange 102 may be made of polymeric materials via an additive manufacturing process, an injection molding process, or another suitable process.

Figure 11:
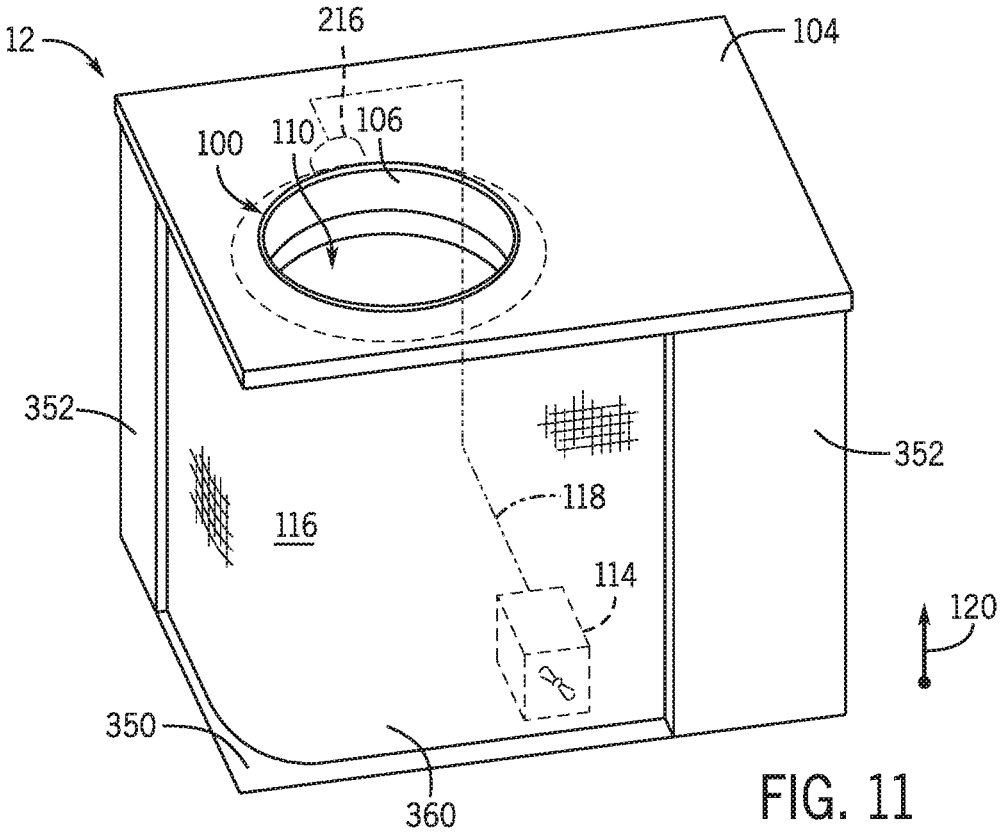
FIG. 11 is a perspective view of an embodiment of an HVAC unit that includes an air flow amplifier, in accordance with an aspect of the present disclosure.

FIG. 11 is a perspective view of another embodiment of the HVAC unit 12. In the illustrated embodiment, the air flow amplifier 100 includes a single ring, such as the outer ring 106. Indeed, it should be understood that the air flow amplifier 100 may include any suitable quantity of rings that enables operation of the air flow amplifier 100 to improve overall air flow through the HVAC unit 12, improve operation of the flow generating device, such as the fan 114, providing the primary air flow 240, and/or reduce costs associated with the HVAC unit 12. As an example, in some embodiments, a quantity of rings included in the air flow amplifier 100 may be increased as a diametric dimension of an outer-most ring included in the air flow amplifier 100 increases.

Figure 12:
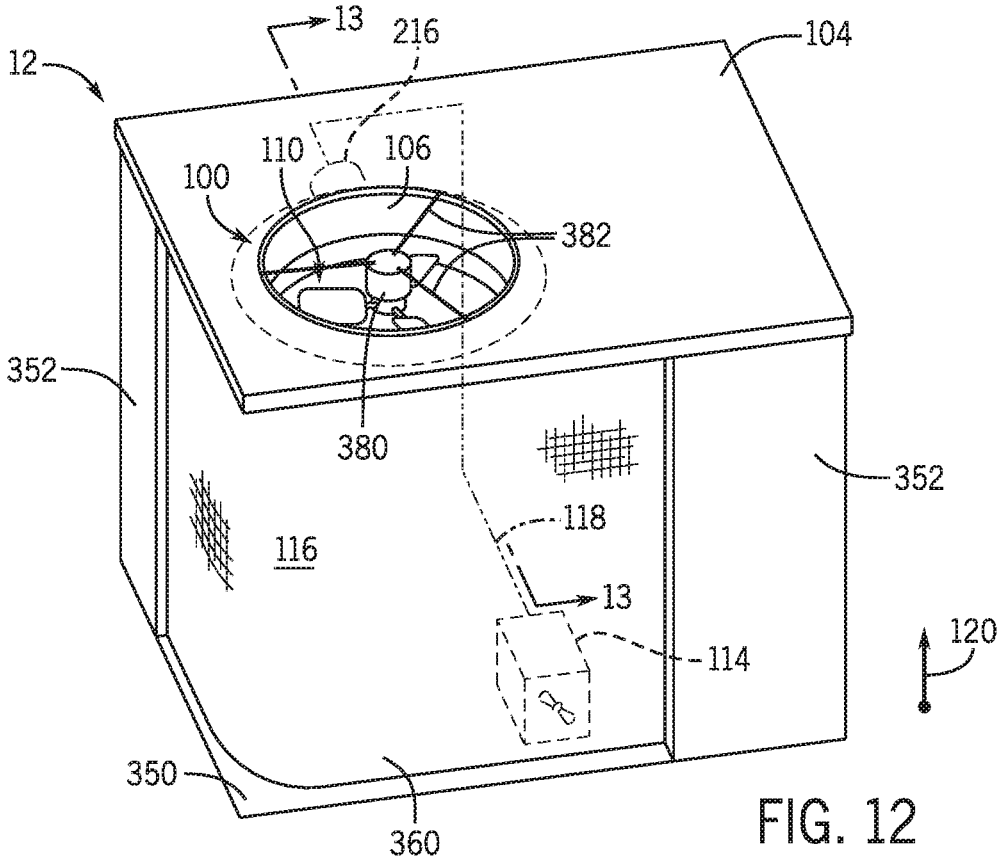
FIG. 12 is a perspective view of an embodiment of an HVAC unit that includes an air flow amplifier, in accordance with an aspect of the present disclosure.

FIG. 12 is a perspective view of another embodiment of the HVAC unit 12. In the illustrated embodiment, the air flow amplifier 100 includes a single ring, such as the outer ring 106, and an auxiliary fan 380 positioned within the outer ring 106. The auxiliary fan 380 may be coupled to the support flange 102 and/or to the fan deck 104 via one or more support rods 382. In some embodiments, the auxiliary fan 380 may supplement the outer ring 106 in expelling air from the interior 116 of the cabinet 24. That is, the auxiliary fan 380 may facilitate drawing air through the heat exchanger 360 and into the interior 116, and subsequently expelling the air from the interior 116 via the opening 110. Accordingly, the auxiliary fan 380 may facilitate increasing a flow rate of the secondary air flow 300 directed through the opening 110.

Figure 13:
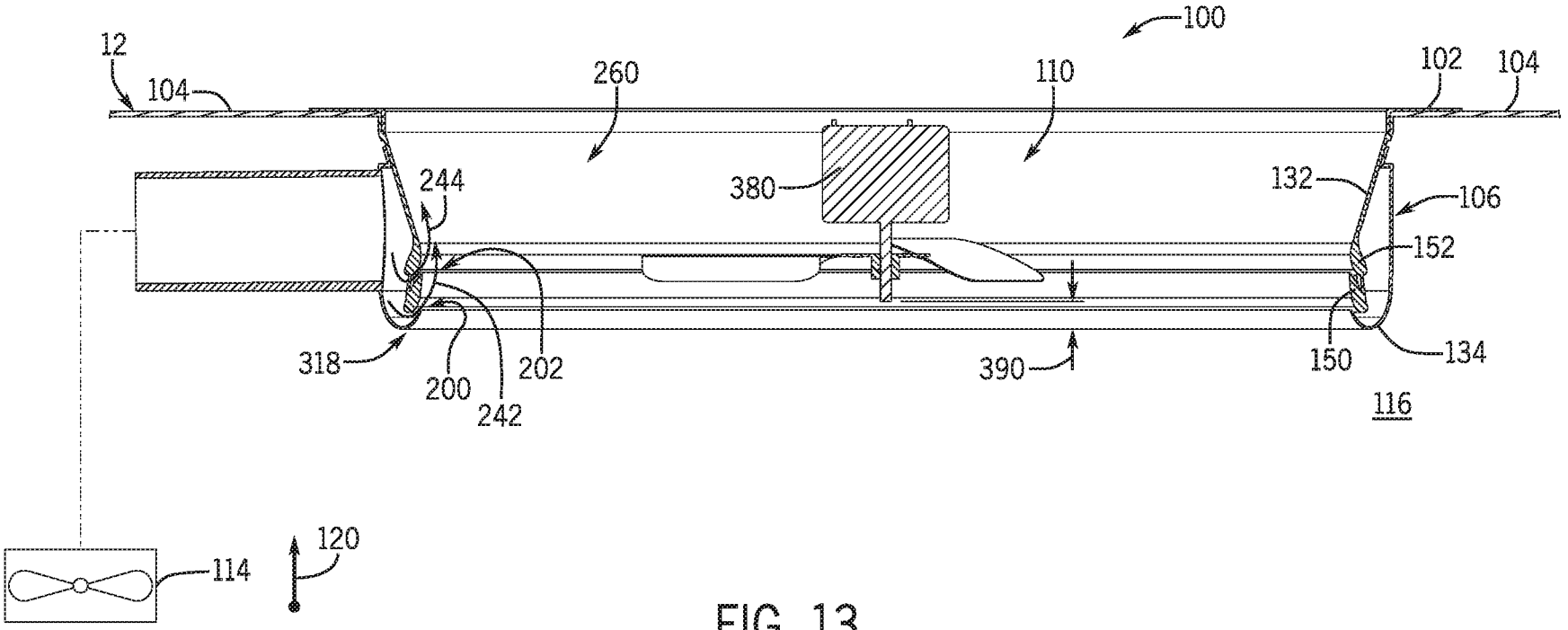
FIG. 13 is a cross-sectional side view of an embodiment of a portion of an HVAC unit, taken along line 13-13 of FIG. 12, in accordance with an aspect of the present disclosure.

FIG. 13 is a cross-sectional side view of an embodiment of a portion of the HVAC unit 12 taken along line 13-13 of FIG. 12. As shown in the illustrated embodiment, the auxiliary fan 380 may be positioned downstream, with respect to a direction of air flow through the opening 110, of the upstream end portion 318 of the outer ring 106 by a distance 390. Particularly, the auxiliary fan 380 may be positioned downstream, with respect to the direction of air flow through the opening 110, of the first air flow outlet 200, and positioned substantially adjacent to the second air flow outlet 202. In other embodiments, the auxiliary fan 380 may be positioned downstream, with respect to the direction of air flow through the opening 110, of both the first air flow outlet 200 and the second air flow outlet 202. In any case, as such, the auxiliary fan 380 may facilitate drawing air, such as the first air flow 242 and the second air flow 244, out of the first air flow outlet 200 and the second air flow outlet 202, respectively, and directing the first air flow 242 and the second air flow 244 along the inner diameter 260 of the outer ring 106. To this end, the auxiliary fan 380 may facilitate induction of the secondary air flow 300 through the air flow amplifier 100 in accordance with the techniques discussed above. As noted above, it should be understood that, in certain embodiments, the first air flow outlet 200 or the second air flow outlet 202 may be omitted from the air flow amplifier 100, such that the air flow amplifier includes a single air flow outlet.

Figure 14:
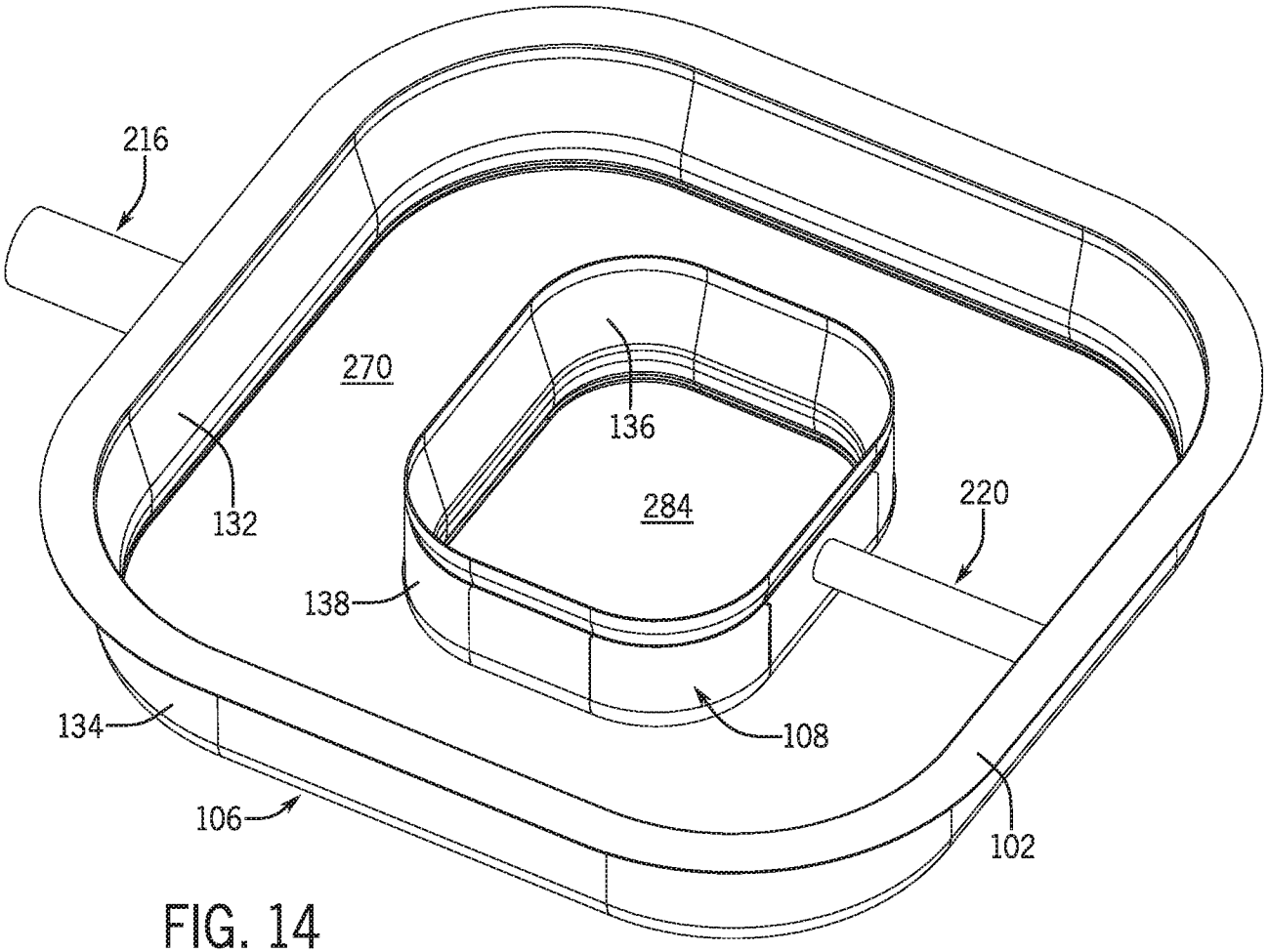
FIG. 14 is a top perspective view of an embodiment of an air flow amplifier, in accordance with an aspect of the present disclosure.

FIG. 14 is a perspective view of another embodiment of the air flow amplifier 100. In the illustrated embodiment, the outer ring 106 and the inner ring 108 each include a generally quadrilateral shape or geometry. Indeed, it should be understood that the outer ring 106 and the inner ring 108 are not limited to rings having generally circular geometries and, instead, may include rings having any suitable geometries or shapes. For example, the first and second rings 106, 108 may each include a generally oval geometry, a generally triangular geometry, a generally square geometry, or another suitable geometric shape. In some embodiments, the inner ring 106 and the outer ring 108 may each have the same geometric shape or may have different geometric shapes. As a non-limiting example, the outer ring 106 may include a generally circular geometry while the inner ring 108 includes a generally quadrilateral geometry.

As set forth above, embodiments of the present disclosure may provide one or more technical effects useful for providing more efficient direction of air along a flow path of an HVAC system and/or across a heat exchanger of the HVAC system. Additionally, present embodiments of the air flow amplifier may enable the positioning of moving fan components in protected or shielded areas of the HVAC system in order to reduce or eliminate exposure of the moving fan components to environmental elements. As such, the air flow amplifier may effectively direct air along a flow path of the HVAC system and/or across certain components of the HVAC system while reducing an overall energy consumption of the HVAC system, increasing an overall operational life of certain fan assembly components, and/or reducing maintenance of certain fan assembly components. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

an air flow amplifier coupled to a fan deck of the HVAC unit, wherein the air flow amplifier includes:

a ring having an outer shroud and an inner shroud extending about a central axis to define an annular cavity of the ring, wherein the outer shroud has a circumferential edge, and wherein the inner shroud includes a first annular member and a second annular member;

an air flow inlet formed in the ring and configured to direct an air flow into the annular cavity;

a first annular air flow outlet formed between the circumferential edge and the first annular member, wherein the first annular air flow outlet is configured to direct a first portion of the air flow out of the annular cavity and along an inner diameter of the ring in a downstream direction, wherein the circumferential edge overlaps with a first leading edge of the first annular member along the central axis such that the circumferential edge is downstream of the first leading edge with respect to the downstream direction;

a second annular air flow outlet formed between the first annular member and the second annular member, wherein the second annular air flow outlet is configured to direct a second portion of the air flow out of the annular cavity and along the inner diameter of the ring in the downstream direction, wherein a trailing edge of the first annular member overlaps with a second leading edge of the second annular member along the central axis such that the trailing edge is downstream of the second leading edge with respect to the downstream direction; and an additional ring having an additional annular cavity, a first additional air flow outlet formed in the additional ring and configured to direct a first inner ring air flow out of the additional annular cavity and along an additional inner diameter of the additional ring, and a second additional air flow outlet formed in the additional ring and configured to direct a second inner ring air flow out of the additional annular cavity and along the additional inner diameter of the additional ring.

2. The HVAC unit of claim 1, comprising an air supply conduit configured to extend from a fan positioned at a base of the HVAC unit to the air flow inlet.

3. The HVAC unit of claim 1, wherein the additional ring includes an additional air flow inlet formed in the additional ring and configured to direct a third portion of the air flow from the annular cavity into the additional annular cavity, wherein the first additional air flow outlet is configured to direct a first amount of the third portion of the air flow out of the additional annular cavity and along the additional inner diameter of the additional ring as the first inner ring air flow, and the second additional air flow outlet is configured to direct a second amount of the third portion of the air flow out of the additional annular cavity and along the additional inner diameter of the additional ring as the second inner ring air flow.

4. The HVAC unit of claim 1, wherein the annular cavity and the additional annular cavity are fluidly coupled to one another via an intermediate conduit extending radially between the ring and the additional ring.

5. The HVAC unit of claim 1, wherein the ring and the additional ring are offset from one another along the central axis.

6. The HVAC unit of claim 1, wherein the ring and the additional ring are concentric with one another.

7. The HVAC unit of claim 1, comprising an annular support structure configured to secure the ring to the fan deck.

8. The HVAC unit of claim 7, comprising a plurality of braces coupled to the annular support structure and to the additional ring.

9. The HVAC unit of claim 1, wherein the second annular air flow outlet includes at least two open sections separated by support ribs extending between the first annular member and the second annular member of the inner shroud.

10. A heating, ventilation, and/or air conditioning (HVAC) unit, comprising:

a cabinet comprising a heat exchanger disposed therein, wherein the cabinet is configured to receive an ambient air flow, and the heat exchanger is configured to transfer heat between the ambient air flow and a refrigerant circulated through the heat exchanger;

a panel of the cabinet, wherein the panel comprises an opening formed therein; and an air flow amplifier positioned adjacent to the opening, wherein the air flow amplifier includes:

an outer ring having an annular cavity;

an inlet conduit configured to receive a first portion of the ambient air flow and direct the first portion of the ambient air flow as a primary air flow into the annular cavity;

a first air flow outlet formed in the outer ring and configured to direct a first portion of the primary air flow out of the annular cavity and through the opening in a downstream direction;

a second air flow outlet formed in the outer ring and configured to direct a second portion of the primary air flow out of the annular cavity and through the opening in the downstream direction, wherein the first air flow outlet and the second air flow outlet are formed in a radially-inner side of the outer ring;

an inner ring positioned radially within the outer ring and having an additional annular cavity configured to receive a third portion of the primary air flow from the annular cavity; and a third air flow outlet formed in the inner ring and configured to direct an inner ring air flow out of the additional annular cavity and through the opening in the downstream direction, wherein a first upstream end portion of the outer ring is disposed upstream of a second upstream end portion of the inner ring with respect to a flow of the first portion of the primary air flow in the downstream direction.

11. The HVAC unit of claim 10, wherein the panel includes a support flange coupled to a circumference of the outer ring to mount the air flow amplifier to the panel.

12. The HVAC unit of claim 10, comprising a fan positioned within the cabinet, wherein the fan is configured to force the primary air flow from an interior of the cabinet into the annular cavity.

13. The HVAC unit of claim 12, wherein the outer ring includes an inner diameter having a diverging portion that diverges radially, with respect to a central axis of the air flow amplifier in the downstream direction, wherein the first and second air flow outlets are configured to direct the first and second portions of the primary air flow along the diverging portion to induce a secondary air flow across the heat exchanger and to direct the secondary air flow through a central flow passage of the outer ring in the downstream direction.

14. The HVAC unit of claim 13, wherein the secondary air flow is a second portion of the ambient air flow.

15. The HVAC unit of claim 10, wherein the air flow amplifier includes a fourth air flow outlet formed in the inner ring and configured to direct an additional inner ring air flow out of the additional annular cavity and through the opening in the downstream direction.

16. The HVAC unit of claim 10, comprising a fan positioned within a central flow passage of the outer ring and configured to direct an additional air flow along the central flow passage and through the opening in the downstream direction.

17. The HVAC unit of claim 10, wherein a first downstream end portion of the outer ring is disposed upstream of a second downstream end portion of the inner ring with respect to the flow of the first portion of the primary air flow in the downstream direction.

18. An air flow amplifier for a heating, ventilation, and/or air conditioning (HVAC) unit, comprising:

an outer ring coupled to a structure of the HVAC unit, wherein the outer ring comprises an outer shroud and an inner shroud that define an annular cavity configured to receive an air flow, wherein the outer shroud comprises a circumferential edge, and wherein the inner shroud comprises a first annular member and a second annular member;

a first air flow outlet formed in the outer ring between the circumferential edge and the first annular member, wherein the first air flow outlet is configured to direct a first portion of the air flow out of the annular cavity and along an inner diameter of the outer ring in a downstream direction, wherein the circumferential edge is downstream of a first leading edge of the first annular member with respect to the downstream direction;

a second air flow outlet formed in the outer ring between the first annular member and the second annular member, wherein the second air flow outlet is configured to direct a second portion of the air flow out of the annular cavity and along the inner diameter of the outer ring in the downstream direction, wherein a trailing edge of the first annular member is downstream of a second leading edge of the second annular member with respect to the downstream direction;

an inner ring positioned radially within the outer ring and having an additional annular cavity configured to receive a third portion of the air flow from the annular cavity;

a third air flow outlet formed in the inner ring and configured to direct an inner ring air flow out of the additional annular cavity and along an additional inner diameter of the inner ring, wherein a first upstream end portion of the outer ring is disposed upstream of a second upstream end portion of the inner ring with respect to the downstream direction; and a fourth air flow outlet formed in the inner ring and configured to direct an additional inner ring air flow out of the additional annular cavity.

19. The air flow amplifier of claim 18, wherein the fourth air flow outlet is configured to direct the additional inner ring air flow nd along the additional inner diameter of the inner ring.

20. The air flow amplifier of claim 19, wherein the outer ring and the inner ring form an annular flow passage extending radially between the outer ring and the inner ring from the first upstream end portion of the outer ring to a first downstream end portion of the outer ring, wherein a radial dimension of the annular flow passage, with respect to a central axis of the air flow amplifier, increases between the first upstream end portion and the first downstream end portion.

21. The air flow amplifier of claim 20, wherein the inner ring forms an additional flow passage extending between the second upstream end portion of the inner ring and a second downstream end portion of the inner ring, wherein an additional radial dimension of the additional flow passage, with respect to the central axis of the air flow amplifier, increases between the second upstream end portion and the second downstream end portion.

22. The air flow amplifier of claim 18, comprising an annular support flange coupled to the outer ring and configured to couple the air flow amplifier to a panel of the HVAC unit.

* * * * *